US005497759A

United States Patent [19]

Guenin

[11] Patent Number: 5,497,759

[45] Date of Patent: Mar. 12, 1996

[54] DRIVING APPARATUS FOR A DIAMOND TOOLHOLDER

[75] Inventor: Maurice Guenin, La Chaux-de-Fonds, Switzerland

[73] Assignee: Voumard Machines Co. S.A., Switzerland

[21] Appl. No.: 166,825

[22] Filed: Dec. 15, 1993

[30] Foreign Application Priority Data

Dec. 23, 1992 [EP] European Pat. Off. ..... 92811021

[51] Int. Cl.[6] ..... B24B 53/065

[52] U.S. Cl. ..... 125/11.01; 125/11.05; 125/11.11; 451/72

[58] Field of Search ..... 125/11.04, 11.05, 125/11.13, 11.02, 11.06, 11.18, 11.11; 451/21, 72

[56] References Cited

U.S. PATENT DOCUMENTS

| | | | |
|---|---|---|---|
| 1,905,390 | 4/1933 | Lindner | 125/11.05 |
| 2,317,411 | 11/1941 | Seyferth | 125/11.05 |
| 3,269,381 | 8/1966 | Healy . | |
| 5,003,730 | 4/1991 | Halvorsen | 125/11.11 |
| 5,138,799 | 8/1992 | Buckingham et al. | 451/21 |
| 5,323,572 | 6/1994 | Guehin | 451/72 |

FOREIGN PATENT DOCUMENTS

| | | |
|---|---|---|
| 0304152 | 2/1989 | European Pat. Off. . |
| 0512956 | 11/1992 | European Pat. Off. . |
| 1905144 | 5/1973 | Germany . |
| 1280422 | 7/1972 | United Kingdom . |

*Primary Examiner*—Bruce M. Kisliuk
*Assistant Examiner*—Andrew Weinberg
*Attorney, Agent, or Firm*—Oliff & Berridge

[57] ABSTRACT

The single-motored apparatus includes a motor which rotatingly drives a main shaft and a correction shaft, the main shaft in turn rotatingly driving the diamond toolholder, a clutch for coupling and uncoupling the shafts, and a cam/feeler assembly for transforming the rotary movement of the correction shaft into longitudinal movement of the diamond toolholder. When the correction shaft and the main shaft connected by the clutch rotate simultaneously, the diamond toolholder executes solely an angular movement; when the two shafts are uncoupled and only one of the two shafts rotates, the diamond toolholder executes either solely a longitudinal movement or a longitudinal and angular movement at the same time.

15 Claims, 4 Drawing Sheets

DRIVING APPARATUS FOR A DIAMOND TOOLHOLDER

Figures 1, 1A:
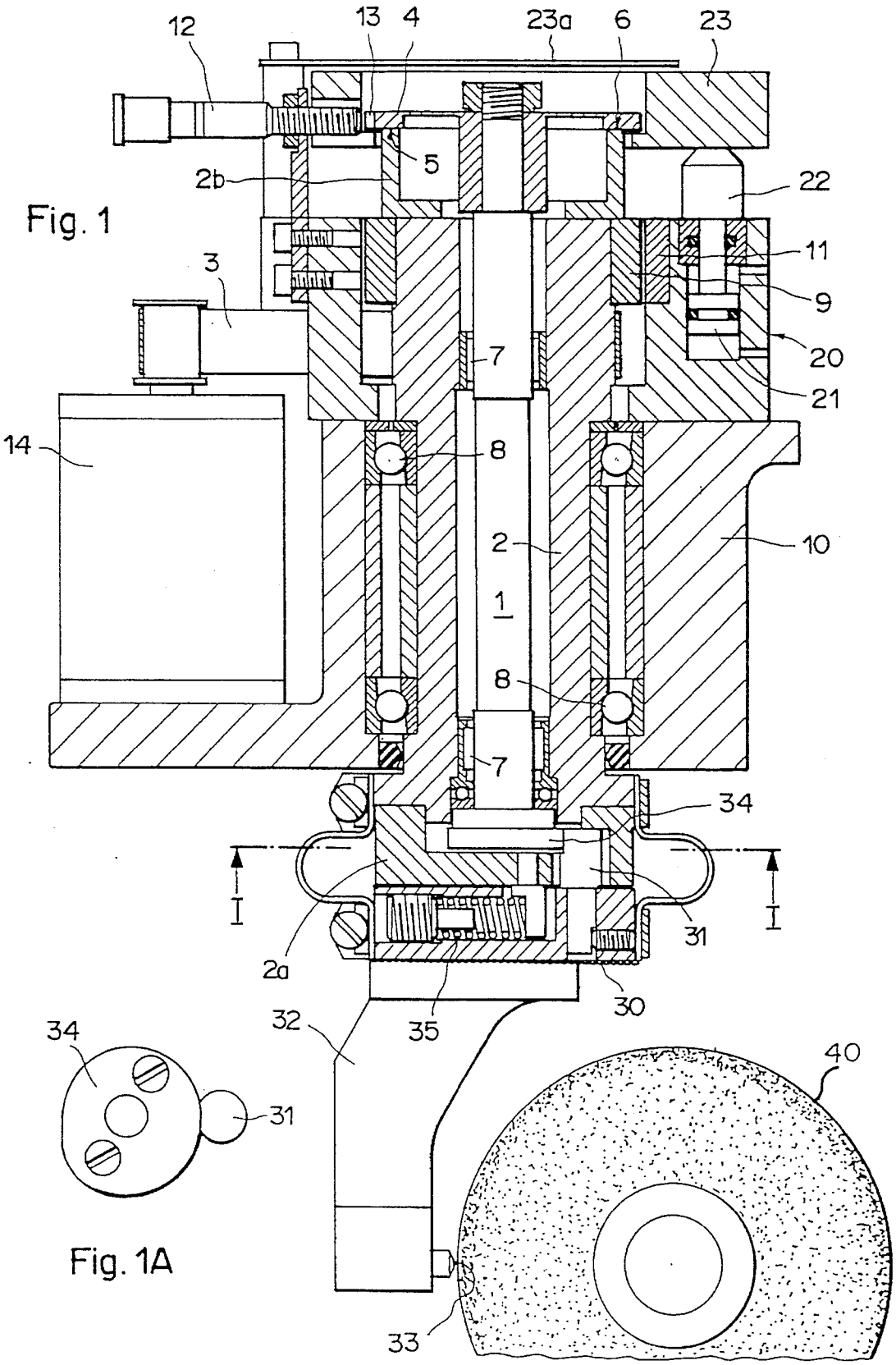

This invention relates to driving apparatus for diamond toolholders, especially for use on grinding machines, particularly of the type in which a diamond toolholder can move angularly and/or longitudinally.

Connected to suitable monitoring apparatus, e.g., to the numerical control of the grinding machine, this apparatus is particularly advantageous for carrying out dressing operations on parts including concave and/or convex portions with or without a straight portion. The great precision obtained by means of the apparatus permits the dressing of tools having machine parts which require a precise finish, such as high-precision bearings.

European Patent Application Publication No. 0 304 152 describes multi-motored driving apparatus for a diamond toolholder having angular and longitudinal movement. The design of this apparatus, with a drive using a first motor for carrying out the angular movements and a second motor for carrying out the longitudinal movements, is complex and cumbersome, for in order to transmit the two types of movement to the diamond toolholder, the mechanism described includes numerous parts, thus negatively affecting both the manufacturing cost of the machine and its precision.

It is an object of this invention to provide driving apparatus for a diamond toolholder having simplified construction and operation.

To this end, in the driving apparatus according to the present invention, of the type initially mentioned, a motor rotatingly drives a main shaft and a correction shaft through the medium of a driving means, the main shaft in turn rotatingly driving the diamond toolholder, and means permit the rotary movement of the correction shaft relative to the main shaft to be transformed into longitudinal movement of the diamond toolholder; clutch means are used for coupling or for uncoupling the shafts, so that when the two shafts coupled by the clutch rotate simultaneously, the diamond toolholder executes solely an angular movement; when only the shaft driven by the driving means uncoupled from the other shaft rotates, the diamond toolholder executes a longitudinal movement.

The inventive apparatus provides numerous advantages. First of all, the fact of using a single motor while at the same time permitting the angular and longitudinal movement of the diamond toolholder to be carried out nonetheless, reduces the cost-price of the apparatus considerably. Moreover, as compared with certain prior art apparatus not permitting the longitudinal movement to be carried out, the present apparatus allows the correction as well as the programming of the radius (longitudinal distance relative to the part) or of the angular movement from the control panel of the machine, and actually improves the convenience and safety at the time of adjustment by confining the manual operations to the inside of the protected operational enclosure of the grinding machine. The elimination of one motor permits the dimensions of the apparatus to be reduced, so that the working space is more efficiently used; the longitudinal stroke available increases the flexibility of use by allowing machining of a very wide range of different parts, including the economical production of small series of parts with frequent set-up changes.

Figure 2:
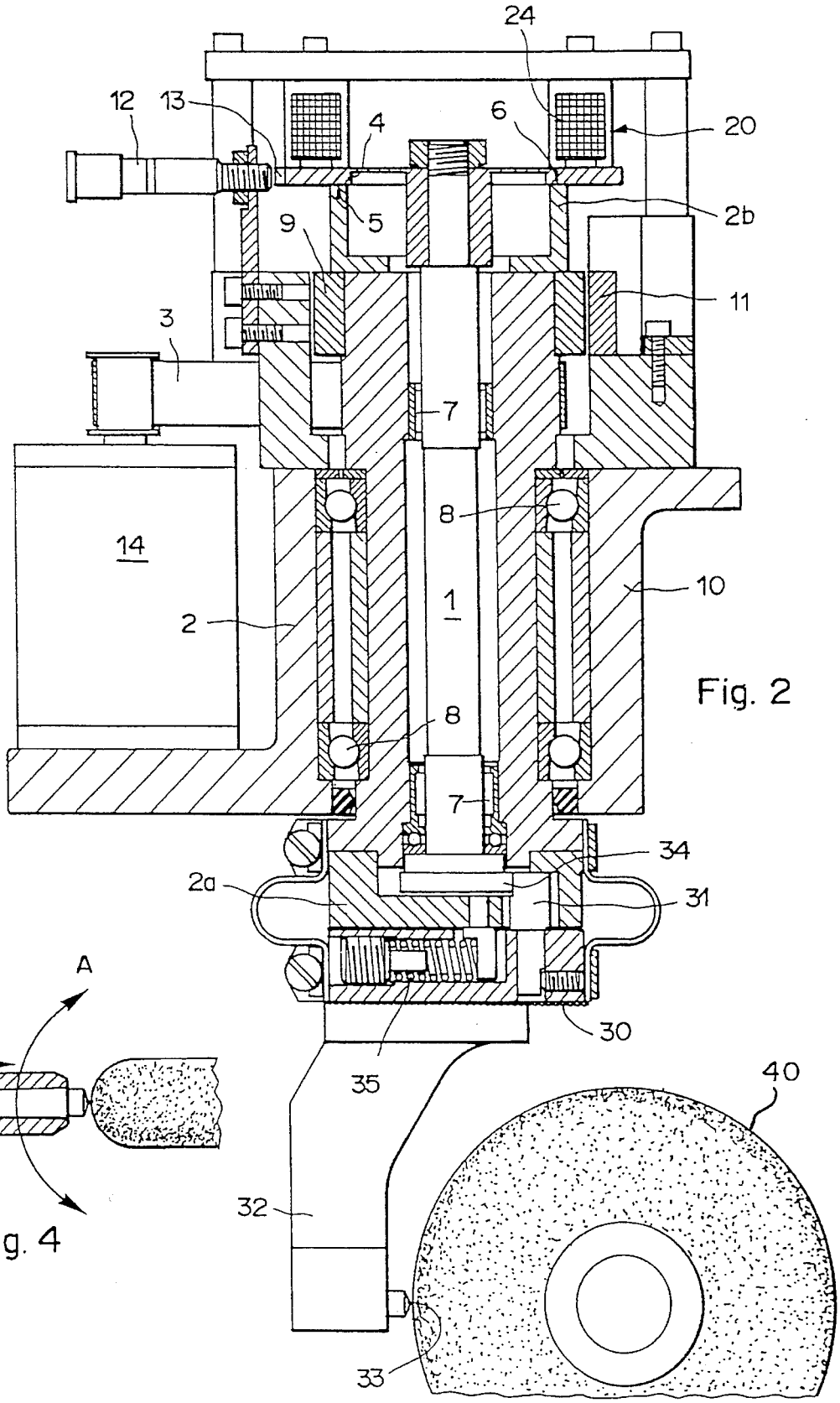
Figure 4:
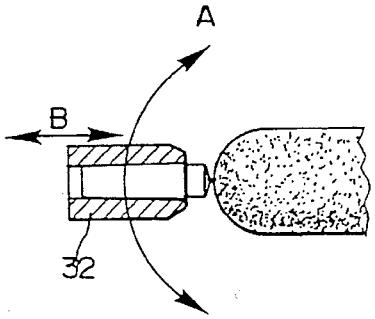
Figure 3:
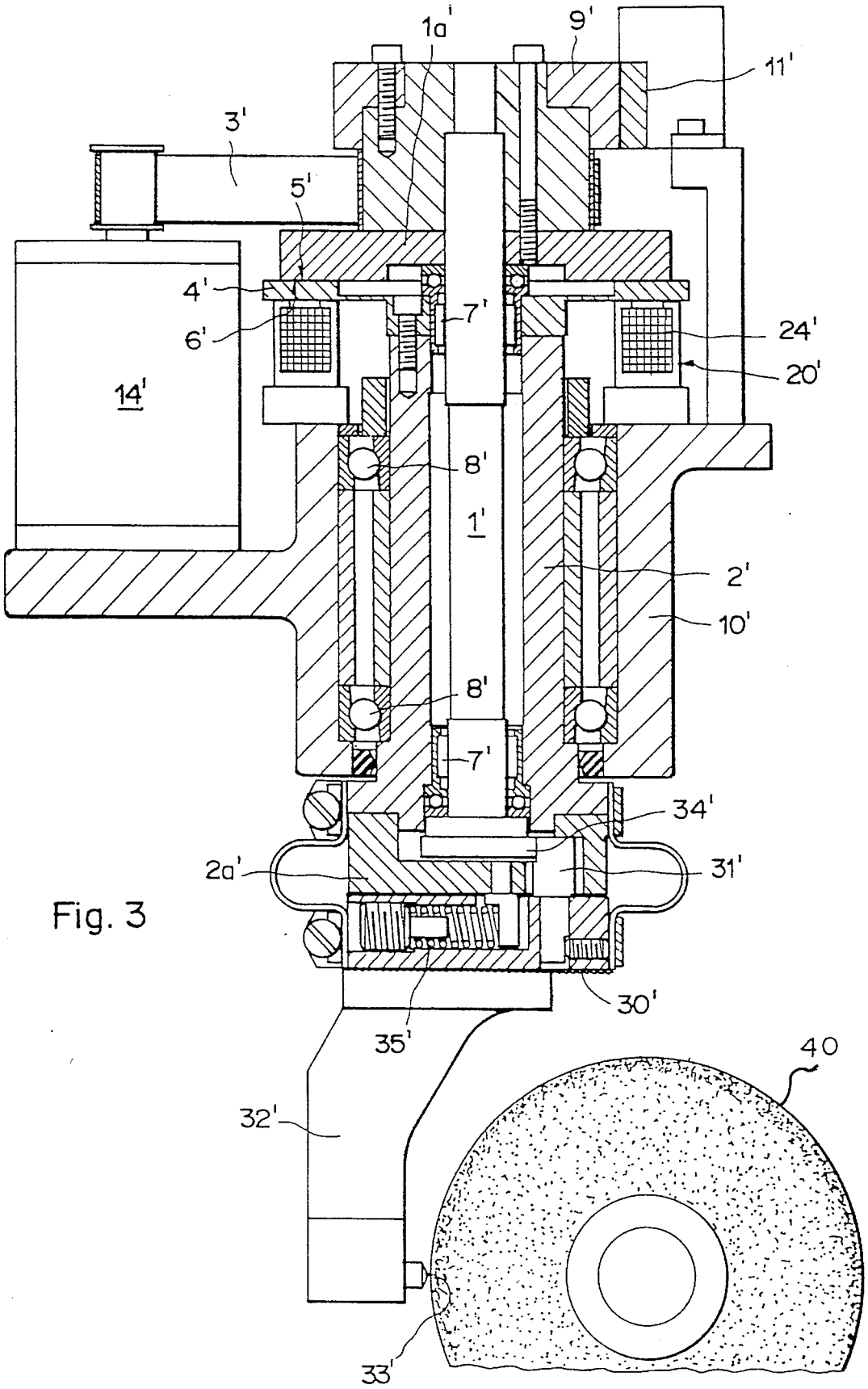
Figure 5:
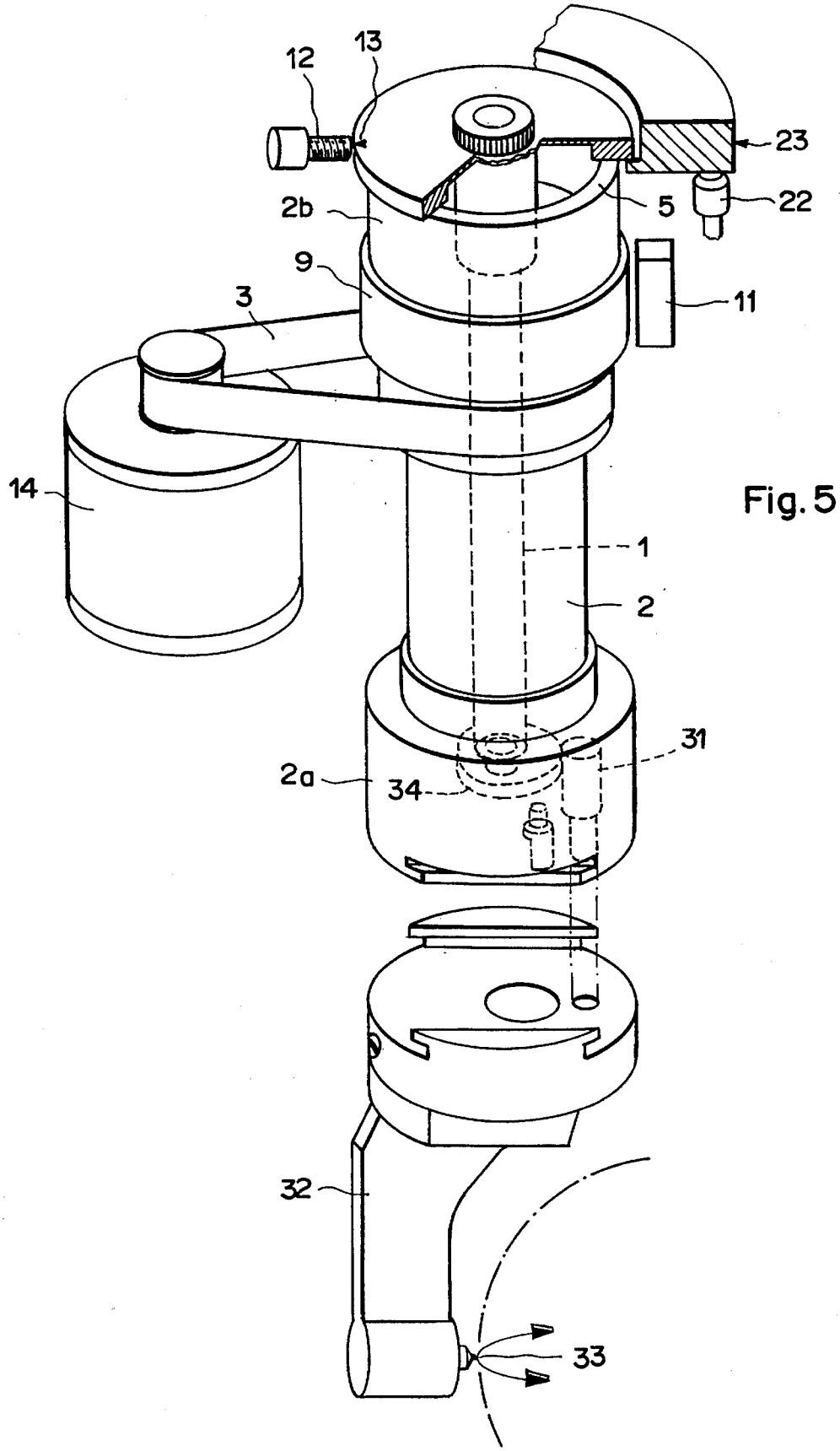

Preferred embodiments of the invention will now be described in detail with reference to the accompanying drawings, in which:

FIG. 1 is a sectional view of the inventive apparatus in a first embodiment, FIG. 1A is a partial view taken on the line I—I of FIG. 1, showing the cam-feeler assembly, FIG. 2 is a sectional view of a modification provided with an electromagnetic-type clutch, FIG. 3 is a sectional view of the apparatus in a second embodiment, FIG. 4 is a detail showing diagrammatically the angular movement of the diamond along the surface to be dressed, and FIG. 5 is a partial perspective view of the apparatus, used for dressing a part.

The inventive apparatus is shown in a general manner in FIG. 5. This perspective view permits the functional rôle of the main elements of the apparatus to be well understood. A motor 14 rotatingly drives a main shaft 2 via a driving means 3. By means to be described below, a correction shaft 1 can be coupled to or dissociated from the main shaft 2 while at the same time making one of the two shafts (the one that remains fixed during the operation of correction of the radius) integral with the frame. A diamond toolholder 32 is disposed under the main shaft 2 via an adapter 2*a* on which the diamond toolholder 32 can slide longitudinally. When the two shafts are coupled, the diamond toolholder 32 is driven rotatingly by the main shaft 2 so that a diamond 33 moves angularly along the contour of the part to be dressed. When the two shafts are uncoupled, the diamond toolholder 32 moves longitudinally so that the diamond 33 moves away from or closer to the part. A great flexibility of movement of the diamond is thus obtained, so that dressing operations can be carried out on practically any shape of part.

In order that the construction and operation of the apparatus may be better understood, the more detailed views of FIGS. 1 to 4 will now be described.

FIG. 1 shows the main elements of a preferred embodiment of the inventive apparatus. The inner correction shaft 1 is disposed centrally in the hollow main shaft 2. Ball, roller, or some other type of bearings 7 hold the shaft 1 while at the same time permitting its rotation in the shaft 2. For better balancing and for more precision, the shaft 1 is held by at least two bearings spaced from one another: a first, radial-type bearing disposed along the shaft 1, and a second bearing, preferably of axial-radial type, disposed preferably at the lower end of the shaft 1. Such an arrangement gives an optimum radial and axial hold, while at the same time acting against the force of gravity. The lower part of the shaft 2 extends under the frame 10 and ends in an adapter 2*a*, fixed to the lower end of the shaft 2. The adapter 2*a* permits the various moving elements of the apparatus to be connected to the shaft 2, which can therefore drive all these elements rotatingly along with it. The shaft 2 then extends upward over at least part of the length of the shaft 1. The shaft 2 is fixed to the frame 10 of the apparatus via at least two spaced, radial-type ball, roller, or other bearings 8. The assembly of the shafts 1 and 2 one within the other via bearings permits either independent rotation of the two shafts or simultaneous rotation thereof. The type of rotation depends upon the relative coupling or uncoupling of the two shafts. This coupling is produced by a clutch 20 to be described below.

The shaft 2 is driven rotatingly by a conventional driving means 3 which may, for example, be a belt, a chain, or a series of gears, associated with an electric or hydraulic motor 14. The belt thus goes around a narrow portion of the shaft 2, the contour of which is preferably adapted in a known manner, e.g., by means of edges, so that the belt remains properly positioned during rotation.

A clutch joint 2b is fixed to the upper end of the main shaft 1. This joint is preferably of an upside-down bell shape so that the end portion of this bell has a flat part, perpendicular to the axis of the shaft, serving as a driving clutch surface 6. A disk 4, centered and fixed to the upper part of the correction shaft 1, includes a driven clutch surface 5, formed at the lower peripheral surface of the same disk, so as to be concomitant with the driving clutch surface 6. The disk 4 is flexible, owing to the presence of a thinned portion extending about the central core. The disk is disposed in such a way that the driven clutch surface 5 presses on the driving clutch surface 6, exerting sufficient pressure to permit driving of the correction shaft. However, because of the flexibility of the disk, the driven clutch surface may be lifted, so that the two clutch surfaces are no longer in contact.

According to a modified embodiment using a non-flexible disk 4, a spring means (not shown), connected to the shaft 1 at one end and the clutch disk 4 at the other, exerts a force upon the latter, tending to push the disk 4 against the driving clutch surface 6. In this way, the driven clutch surface 5 enters in contact with the driving clutch surface 6, thus connecting the two shafts. Moreover, the spring means permits the disk to be slightly lifted so that the two clutch surfaces are no longer in contact.

Seeing that the simultaneous movement of the two shafts 1 and 2 is not always desired (for reasons to be explained below), the apparatus comprises a clutch system 20 for dissociating the shafts. This system is illustrated in FIG. 1 as well. It comprises at least one pusher 22 actuated by conventional means 21, such as hydraulic (cf. FIG. 1), electromechanical, or other means. The pushers 22 are disposed in guide bores placed symmetrically in relation to the axis of rotation of the apparatus in the frame 10 of the machine so as to be able to slide upward or downward along a given path. The pushers act upon a clutch ring 23 connected to the rest of the apparatus by a membrane 23*a*, the purpose of which is to make ring 23 radially integral with the frame 10 while at the same time being free axially. When the clutch system is in its lower position, the clutch ring 23 does not exert any force on the disk 4, so that the driven clutch surface 5 rests on the driving clutch surface 6. The two shafts are then integral with one another. When the clutch system is raised to its upper position, the pusher 22 is lifted, and the clutch ring 23 comes in contact with the disk 4 and lifts it. The two clutch surfaces 5 and 6 are then no longer in contact, thus dissociating the shafts 1 and 2. The correction shaft 1 is then fixed radially to the frame by its connection to the ring 23. When the shaft 2 is caused to rotate by means of the motor, the diamond toolholder 32 rotates and simultaneously moves longitudinally owing to the action of a cam 34 on a feeler 31, as will be described below. For a return to the lower position, the pusher 22 and the ring 23 descend, either solely by the force of gravity or through the action of a return spring (not shown), or else through the action of the hydraulic, electromechanical, or other means 21 mentioned above, carrying the various elements downward.

The apparatus also comprises an encoder, of a type known per se, having a rotary part 9 and a fixed part 11. The rotary part 9, generally taking the form of a ring, is so dimensioned as to be able to fit on the main shaft 2 at an advantageous location, e.g., at the top, as shown in FIG. 1. The fixed part 11 is disposed in immediate proximity to the rotary part 9, at a given angular position.

A correction slide 30, fixed under the adapter 2A, supports the diamond toolholder 32, which can slide longitudinally along the slide 30. This longitudinal movement is guided by the cam 34/feeler 31 system. The cam 34 is disposed at the lower end of the correction shaft 1. The feeler 31 is disposed so as to rest laterally against the edge of the cam 34. When the latter rotates, the feeler 31 moves longitudinally, following the contour of the cam 34. A spring means 35 pulls the feeler 31 toward the axis of rotation of the cam 34, thus holding the feeler 31 against the cam. In this way, the feeler 31 can move in both directions, coming closer to or moving away from the axis of rotation of the cam 34. The diamond toolholder 32 is disposed under the slide 30. The feeler 31 is connected to the diamond toolholder 32, thus permitting transmission of the longitudinal movement to the diamond toolholder. The magnitude of the longitudinal displacement depends directly upon the profile of the cam 34 and the rotation thereof relative to the feeler 31.

The diamond 33 is fixed laterally to the base of the diamond toolholder 32 so as to be situated in the working axis, thus permitting the dressing operation to be carried out on a part 40.

The apparatus is completed by an angular-position sensor 12, disposed near the clutch disk 4. By means of the sensor 12, of a type known per se, the angular position of the correction shaft 1 can be determined relative to the main shaft at the time of an initial sampling, owing to the presence of at least one angular-position reference marker 13 disposed at the periphery of the disk 4.

The operation of the apparatus is monitored by a monitoring means, preferably by the numerical control of the machine tool, as is often the case for the apparatus known to date.

The initial sampling, permitting the exact position of the diamond to be determined relative to the part to be dressed, is effected in a manner known per se, preferably under the surveillance of the numerical control, e.g., in the way shown in European Patent Application Publication No. 0 512 956.

FIG. 4 illustrates the type of movement the diamond toolholder 32 can carry out with the aid of the inventive apparatus. Arrow A indicates an angular movement about the radius or the surface to be dressed, while arrow B indicates a longitudinal movement permitting the diamond 33 to come closer to or move away from the part to be dressed.

According to this first embodiment of the invention, it is possible to execute either solely an angular movement or a simultaneous angular and longitudinal movement. Owing to the various combinations of movements, it is possible to carry out dressing operations according to a multitude of shapes, including straight edges, constant or variable radius edges, or combinations of these shapes.

In the first case, when the clutch 20 is in its lower position, the two shafts are coupled. The main shaft 2 is driven by the driving means 3 and rotates at a given speed, driving the correction shaft 1 along with it. The two shafts thus have an identical angular speed, hence there is no relative movement between the two. The diamond toolholder 32 therefore follows the main shaft 2 in its angular movement.

In the second case, when the clutch 20 is in its upper position, the two shafts are independent. The main shaft 2 is driven by the driving means 3 and rotates at a given speed, whereas the correction shaft 1 is held in a fixed position by the clutch ring 23. In this case, therefore, there is a relative movement between the two shafts. Owing to this relative angular movement, the correction cam 34, which rotates relative to the feeler 31, acts upon the latter by pushing it laterally along its contour. The transmission of the movement by the cam 34 is clearly shown in FIG. 1A. The feeler 31, connected to the diamond toolholder 32, guides the longitudinal movement thereof. Because the main shaft 2 is also rotating, a simultaneous longitudinal movement and angular movement are thus obtained. For this reason, in order to ensure a maximum of safety, it is preferable to push the grinding wheel back at the time of sizable longitudinal movement.

The encoder 9/11 transmits absolute or incremental electrical signals to the monitoring facility of the machine, so that it knows the angular position of the main shaft 2 at all times. By storing data, the monitoring facility can also know the angular position of the correction shaft 1, so that it can determine the angular and longitudinal positions of the diamond toolholder 32.

In a modification, these positions may be determined more easily owing to an angular-position sensor 12 and at least one positioning marker 13: the sensor 12 transmits to the monitoring means a signal corresponding to the angular position of the correction shaft 1. With the aid of the information supplied by the encoder 9/11 and the angular-position sensor 12, the monitoring means can determine the position of the correction shaft 1 relative to the main shaft 2 at all times. The position of the feeler 31 on the cam 34 is thus known, which permits the longitudinal position of the diamond toolholder 32 and the diamond 33 to be obtained directly.

In a modification illustrated in FIG. 2, the clutch 20 is disposed above the clutch disk 4 and comprises at least one electromagnet 24, but preferably several, these being distributed angularly above the disk 4. The electromagnets 24 are controlled by the monitoring means so as either to raise or to lower the disk 4 with the aid of an electromagnetic force of attraction or repulsion, as the case may be.

In the first case, the disk 4 is raised so as to release the driven clutch surface 5. Moreover, the holding force prevents any angular movement of the disk 4, so that the correction shaft 1 does not rotate. As a result, the angular movement and the longitudinal movement are produced simultaneously. In the second case, the disk 4 is placed in its lowered position, resting on the driving clutch surface 6, so that the correction shaft 1 rotates with the main shaft 2 and the disk 4. As a result, only the angular movement is produced. The electromagnets may equally well act against the strength (rigidity) of the disk 4. In this case, the shafts 1 and 2 are coupled when the electromagnets 24 are not excited, and vice versa.

FIG. 3 depicts a second embodiment of the invention. In this drawing figure, those elements of this embodiment which are of the same nature and play the same parts as the corresponding elements of FIGS. 1 and 2 are designated by the same reference numerals, with the addition of a prime (').

The main difference as compared with the preceding embodiment is in the drive of the shafts 1' and 2', for the driving means 3', rather than being connected to the main shaft 2', is connected to the correction shaft 1'. Just as in the preceding case, the driving means 3' is of a type known per se, e.g., a belt (FIG. 3), a chain, a series of gears, etc., associated with an electric or hydraulic motor.

The lower part of the shaft 2' extends under the frame 10' and ends in an adapter **2*a'*, fixed to the lower end of the shaft 2'. The adapter 2*a'* permits the various movable elements of the apparatus to be connected to the shaft 2'. The latter can therefore drive all these elements rotatingly along with it. It then extends upward over at least a portion of the length of the shaft 1' and preferably ends at approximately the same level as the upper part of the electromagnet 24'. The clutch disk 4' is disposed and centered on the upper end of the main shaft 2'. A flexible-type disk is preferably used, as previously described. However, in a modification (not shown), it is possible to use a non-flexible disk 4'. In that case, it is necessary to use a conventional spring fastening permitting the disk 4'** to effect a slight axial movement, so that clutching and declutching of the shafts can take place.

An adapter **1*a'* fixed to the correction shaft 1' forms a widened portion of the shaft 1', of a diameter approximately equal to that of the disk 4'. It is under this adapter that the driving clutch surface 6' is situated. This surface 6' is conformed to the lower peripheral surface of the adapter 1*a'* so as to be concomitant with the driven clutch surface 5'. Because the correction shaft 1' is the driving shaft, the driving and driven clutch surfaces 6', 5' are reversed as compared with the surfaces 5 and 6 of the embodiment where the main shaft 2** is the driving shaft.

The encoder 9'/11' used is disposed preferably at the end of the correction shaft 1', as shown in FIG. 3. It transmits to the monitoring means a signal permitting the latter to know the angular position of the correction shaft 1' at all times. In view of the independence of the angular and longitudinal movements, this yields information permitting the monitoring means to determine directly the longitudinal and angular position of the diamond toolholder 32' and the diamond 33'.

The location of the clutch 20' also differs. Although various types of clutch can be used in this case, e.g., hydraulic or pneumatic, an electromagnetic-type clutch comprising one or more electromagnets 24' is preferable. These electromagnets 24' are preferably disposed under the clutch disk 4' and act either to raise or to lower the disk 4' by means of an electromagnetic force of attraction or repulsion, as the case may be.

In this second embodiment of the invention, either solely an angular movement or solely a longitudinal movement can be executed, independently. By linking these two types of movement judiciously, it is possible to carry out dressing operations according to a multitude of shapes, including straight edges, constant or variable radius edges, or combinations of these shapes.

In the first case, when the clutch 20' is in its raised position, the two shafts are coupled. The correction shaft 1' is driven by the driving means 3' and rotates at a given speed, driving the main shaft 2' along with it. The two shafts thus have an identical angular speed, hence there is no relative movement between the two. The diamond toolholder 32' therefore follows the main shaft 2' in its angular movement.

In the second case, when the clutch 20' is in its lower position, the two shafts are independent. The correction shaft 1' is driven by the driving means 3' and rotates at a given speed, whereas the main shaft 2' is held in a fixed position by the retaining force of the electromagnet 24'. In this case, therefore, there is a relative movement between the shafts 1' and 2'. Owing to this relative angular movement, the correction cam 34', which rotates relative to the feeler 31', acts upon the latter by pushing it laterally along its contour. The transmission of the movement by the cam is clearly shown in FIG. 1A. The feeler 31', connected to the diamond toolholder 32', guides the longitudinal movement thereof. Inasmuch as the main shaft 2' is fixed, solely a longitudinal movement is thus obtained.

What is claimed is:

1. Apparatus for driving a diamond toolholder, said diamond toolholder moving at least one of angularly and longitudinally, the apparatus comprising:

a rotary main shaft for rotatingly driving said diamond toolholder, a rotary correction shaft, a motor, means for drivingly connecting said motor to said rotary main shaft and said rotary correction shaft, conversion means for transforming the rotary movement of said rotary correction shaft relative to said rotary main shaft into longitudinal movement of said diamond toolholder, and clutch means for coupling and uncoupling said rotary main shaft and said rotary correction shaft, wherein said diamond toolholder executes solely an angular movement when the rotary main shaft and the rotary correction shaft are coupled by said clutch means to rotate simultaneously and executes at least a longitudinal movement when the rotary main shaft by said clutch means.

2. The apparatus of claim 1, wherein said conversion means comprises:

an adapter disposed at one end of said main shaft, a correction slide fixed to said adapter, a cam disposed at one end of said correction shaft, a feeler mounted adjacent to said cam, and a spring holding said feeler in contact with a periphery of said cam, wherein said diamond toolholder is disposed for longitudinal movement under said slide, and said feeler is connected to said diamond toolholder.

3. The apparatus of claim 1, wherein said driving means is connected to said main shaft.

4. The apparatus of claim 3, wherein said clutch means comprises a clutch disk connected to said correction shaft and having a driven clutch surface, and a clutch joint connected to said main shaft and having a driving clutch surface.

5. The apparatus of claim 4, wherein said diamond toolholder executes both an angular movement and a longitudinal movement when said main shaft and said correction shaft are uncoupled.

6. The apparatus of claim 5, further comprising a position sensor.

7. The apparatus of claim 1, wherein said driving means is connected to said correction shaft.

8. The apparatus of claim 7, wherein said clutch means comprises an adapter connected to said correction shaft and having a driving clutch surface, and a clutch disk connected to said main shaft and having a driven clutch surface.

9. The apparatus of claim 1, wherein one of the rotary main shaft and the rotary correction shaft is held fixed by said clutch means when said clutch means uncouples said shafts.

10. The apparatus of claim 1, further comprising bearings holding said rotary main shaft and said rotary correction shaft for rotation relative to one another.

11. The apparatus of claim 1, wherein said rotary correction shaft is disposed within said rotary main shaft.

12. The apparatus of claim 1, wherein said rotary correction shaft and said rotary main shaft have an identical axis of rotation.

13. The apparatus of claim 1, wherein a diamond is disposed laterally on said diamond toolholder.

14. The apparatus of claim 1, further comprising a rotary encoder coupled to the rotary main shaft.

15. A grinding machine equipped with an apparatus for driving a diamond toolholder, said diamond toolholder moving at least one of angularly and longitudinally, said apparatus comprising:

a rotary main shaft for rotatingly driving said diamond toolholder, a rotary correction shaft, a motor, means for drivingly connecting said motor to said rotary main shaft and said rotary correction shaft, conversion means for transforming the rotary movement of said rotary correction shaft relative to said rotary main shaft into longitudinal movement of said diamond toolholder, and clutch means for coupling and uncoupling said rotary main shaft and said rotary correction shaft, wherein said diamond toolholder executes solely an angular movement when the rotary main shaft and the rotary correction shaft are coupled by said clutch means to rotate simultaneously and executes at least a longitudinal movement when the rotary main shaft and the rotary correction shaft are coupled by said clutch means.

* * * * *